US005581946A

United States Patent [19]

Lin

[11] Patent Number: 5,581,946

[45] Date of Patent: Dec. 10, 1996

[54] DOOR SEALING MECHANISM

[76] Inventor: Chen-Yi Lin, 2nd Fl., No. 11, Lane 16, nan Kang Rd., Sec. 3, Taipei, Taiwan

[21] Appl. No.: 501,226

[22] Filed: Jul. 11, 1995

[51] Int. Cl.[6] ..... E06B 7/16

[52] U.S. Cl. ..... 49/368; 49/483.1

[58] Field of Search ..... 49/366, 367, 368, 49/475.1, 483.1

[56] References Cited

U.S. PATENT DOCUMENTS

| | | | |
|---|---|---|---|
| 1,948,017 | 2/1934 | Wuebling | 49/483.1 X |
| 2,797,958 | 7/1957 | Podolan | 49/483.1 X |
| 2,825,940 | 3/1958 | Kurtz | 49/366 |
| 2,933,784 | 4/1960 | Hooverson | 49/483.1 X |
| 3,487,581 | 1/1970 | Ellingson | 49/366 X |
| 3,959,927 | 6/1976 | Good . | |
| 5,349,782 | 9/1994 | Yulkowski | 49/368 X |

FOREIGN PATENT DOCUMENTS

| | | |
|---|---|---|
| 333046 | 7/1929 | United Kingdom . |
| 411361 | 10/1933 | United Kingdom . |
| 464036 | 10/1935 | United Kingdom . |
| 493423 | 3/1938 | United Kingdom . |
| 1207142 | 6/1967 | United Kingdom . |

*Primary Examiner*—Kenneth J. Dorner
*Assistant Examiner*—Jerry Redman
*Attorney, Agent, or Firm*—Lowe, Price, LeBlanc & Becker

[57] ABSTRACT

Disclosed is a door sealing mechanism for sealing the gap between two doors or that gap between one door and the doorframe so as to prevent leakage of the inside conditioned air to the outside or entrance of the outside dust, smoke, and insects into the room. The sealing mechanism includes a blocking mechanism enclosed in a sidepiece provided on the first door and consisted of a blocking member, a movable member supporting the block member, and elastic element means coupled to the movable member. On the opposite side, a curved recess or a cushioning mechanism is provided that receives the blocking member. When the door unit is closed, the blocking member comes into air-tight contact with the curved recess or the cushioning mechanism due to the elasticity of the elastic element; and when opening the door unit, the blocking member can slide away smoothly. Furthermore, with the provisions of bumping members, noises generated by metal collisions when opening or closing the door unit is substantially eliminated.

11 Claims, 11 Drawing Sheets

DOOR SEALING MECHANISM

BACKGROUND OF THE INVENTION

1. Field of the Invention

The present invention relates to sealing mechanisms, and more particularly, to a door sealing mechanism used to seal the gap normally left through doors when the doors are closed so as to prevent leakage of the inside conditioned air to the outside or entrance of the outside dust, smoke, and insects into the room.

2. Description of Prior Art

Doors are usually provided at the entrance from the outside to a building or between two rooms. FIG. 1 shows a two-door unit that includes two doors 1, 2 while FIG. 2 shows a one-door unit that includes only one door 1A. All the doors 1, 2, 1A mentioned here can be rotated in 180 degrees, allowing them to be pushed either inwards or outwards.

Referring to the last two drawings FIGS. 13A–13B, taken the two-door unit as example, it is a common drawback that although the door unit is closed, air gaps are usually left between the two doors 1, 2 (as indicated by G1) and between each of the two doors 1, 2 and the doorjambs 3, 3' to which the two doors 1, 2 are hinged (as indicated by G2 and G2'). The existence of these air gaps G1, G2, G3 allows the entrance of outside dust, smoke, insects, or noises into the interior and the escape of conditioned air to the outside. In the event of a fire, the fumes, hot air, and carbon monoxide could pass through these gaps to the neighboring rooms.

To solve the aforementioned problem, one simple method is to use a cover C affixed to one of the doors 1, 2 such that when the door unit is closed, the cover C could block the air passage through the gap G1. It is a drawback of this method that the air-tightness provided by the cover C is very poor. Moreover, the provision of the cover C causes the doors to open only in one direction and could spoil the aesthetic appearance of the door unit. Besides, this method cannot be used to block air passage through the gaps G2, G2'.

SUMMARY OF THE INVENTION

It is therefore a primary objective of the present invention to provide a door sealing mechanism which can seal the gap between the doors in a two door unit and the gap between one door and the doorjamb to which the door is hinged so as to prevent leakage of the inside conditioned air to the outside or entrance of the outside dust, smoke, and insects into the room It is another objective of the present invention to provide a door sealing mechanism whose installation will not inconvenience the opening of the door unit.

It is still another objective of the present invention to provide a door sealing mechanism which is hidden when the door unit is closed so as not to spoil the outer esthetic appearance of the door unit.

In accordance with the foregoing and other objectives of the present invention, there is provided with a novel door sealing mechanism. Essentially, the sealing mechanism according to the present invention is embodied in two types. The first type comprises (a) a blocking mechanism enclosed in a sidepiece provided on the first door and (b) a curved recess provided on the second door. The blocking mechanism is composed of (i) a blocking member shaped with a curved surface; (ii) a movable member supporting the block member, the movable member being retractable when the blocking member is subject to an exerting force; and (iii) elastic means such as spiral spring, coupled to the movable member, for restoring the movable member to original position when the exerting force on the blocking member is removed. When the first door and the second door are closed, the blocking member coming into tight contact with the curved recess due to the elasticity of the elastic means; and when opening the first door and the second door, the blocking member sliding along the curvature of the curved recess to thereby leave the contact with the curved recess.

And the second type of the sealing mechanism comprises (a) a blocking mechanism enclosed in a sidepiece provided on the first door, and (b) a cushioning mechanism provided on the second door. The blocking mechanism is identical in structure and function as that in the first type, composed of (i) a blocking member shaped with a curved surface; (ii) a first movable member supporting the block member, the movable member being retractable when the blocking member is subject to an exerting force; and (iii) first elastic means such as spiral spring, coupled to the movable member, for restoring the movable member to original position when the exerting three on the blocking member is removed. On the opposite side, the cushioning mechanism is composed of a buffering member opposing the blocking member in the blocking mechanism; (ii) a second movable member supporting the buffering member, the movable member being retractable when the buffering member is subject to an-exerting three; and (iii) second elastic means such as spiral spring, coupled to the second movable member, for restoring the movable member to original position when the exerting force on the buffering member is removed. When the first door and the second door are closed, the blocking member coming into tight contact with the bumping member in the cushioning mechanism due to the elasticity of the first elastic means and the second elastic means; and when opening the first door and the second door with a pushing force, the pushing force causes the blocking member and the bumping member to withdraw such that the blocking member can be moved smoothly from the contact with the bumping member.

In the blocking mechanism, a pair of buffering members can be provided on the movable member so as to prevent noise from being generated by metal collisions when opening or closing the door unit. In other variations, the curved recess can be formed with a niche for stuffing a buffering member opposing said blocking member or simply attached with a buffering member thereon opposing said blocking member so as to provide more air-tight sealing effect to the door unit and also substantially eliminate the noise generated by the collision between the blocking member and the curved recess when opening or closing the door unit. In the cushion mechanism provided on the second type of the sealing mechanism, a pair of bumping members can be provided for preventing bumping noise from being generated due to metal collision.

With the foregoing provisions, the sealing mechanism according to the present invention allows great air-tightness to the sealing of the door unit. Air entrance or escape through the door unit when it is closed is thus prevented. Furthermore, even though the sealing mechanism includes metal-made movable members, the door unit can still be opened or closed quietly without producing noise.

BRIEF DESCRIPTION OF DRAWINGS

The present invention can be more fully understood by reading the subsequent detailed description of the preferred embodiments thereof with references made to the accompanying drawings, wherein:

FIGS. 3A–3B are cross-sectional views of a sealing mechanism according to the first preferred embodiment of the present invention, wherein FIG. 3A shows the two-door unit in closed condition, and FIG. 3B shows the two-door unit half opened;

FIGS. 5A–5B show a buffering member employed in the sealing mechanism shown in FIGS. 3A–3B FIGS. 6A–6B are cross-sectional views of a sealing mechanism according to the second preferred embodiment of the present invention, wherein

FIGS. 7A–7B are cross-sectional views of a sealing mechanism according to the third preferred embodiment of the present invention, wherein FIG. 7A shows the door unit in closed condition, and FIG. 7B shows the door unit half opened;

DETAILED DESCRIPTION OF PREFERRED EMBODIMENT

First Preferred Embodiment

Figure 1:
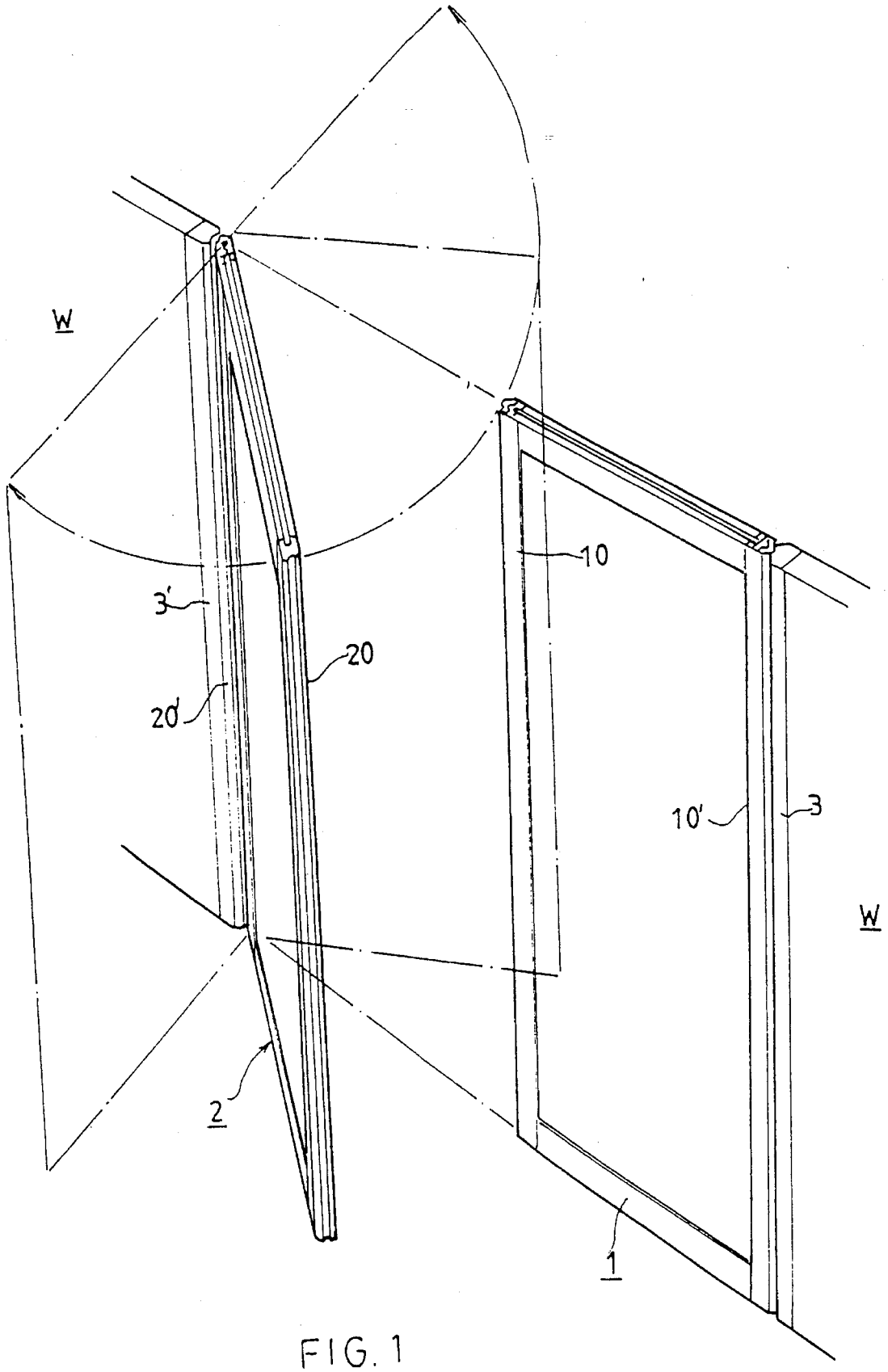
FIG. 1 shows a perspective view of a two-door unit.
Figure 2:
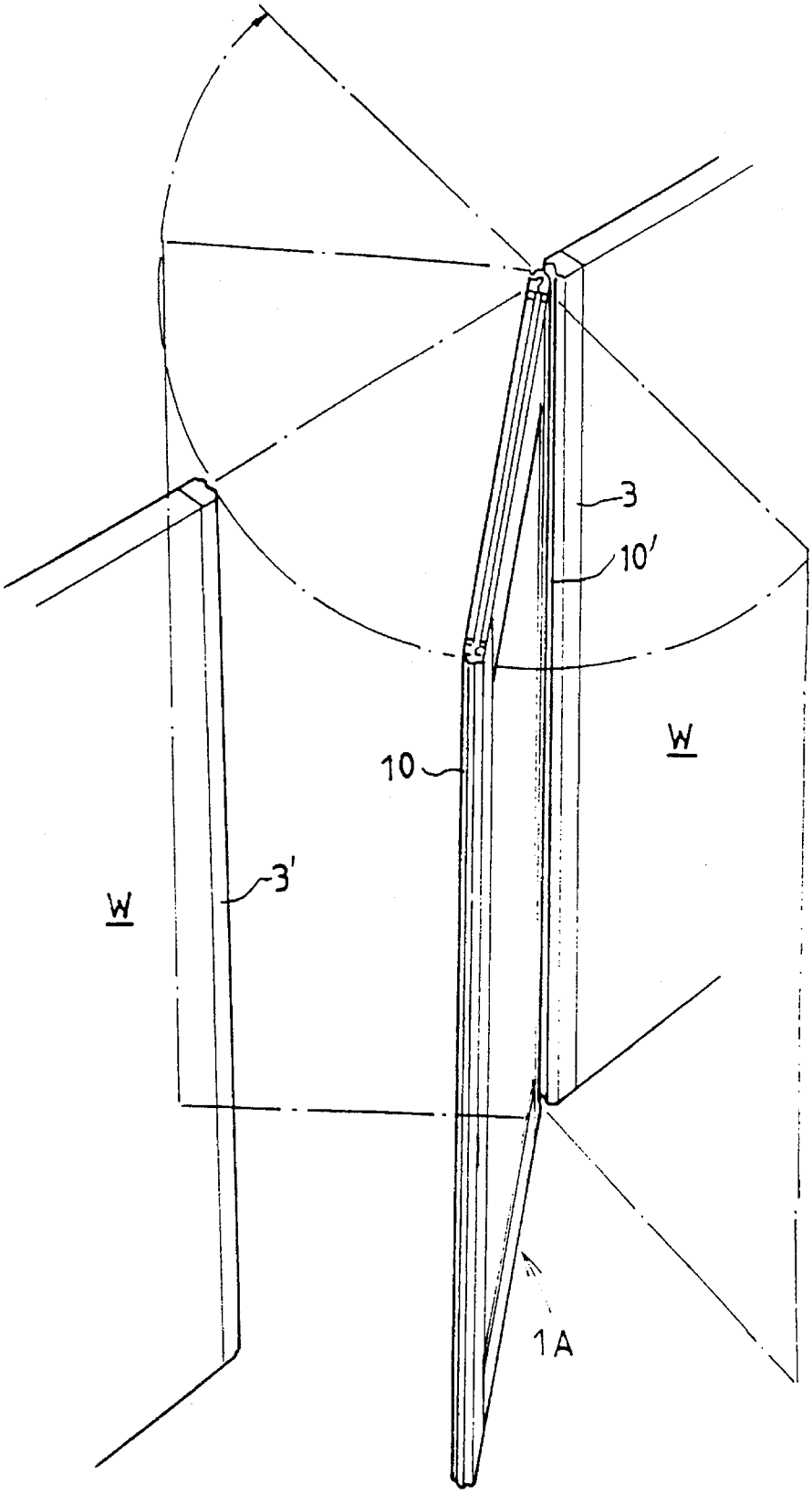
FIG. 2 shows a perspective view of a one-door unit.
Figure 3A:
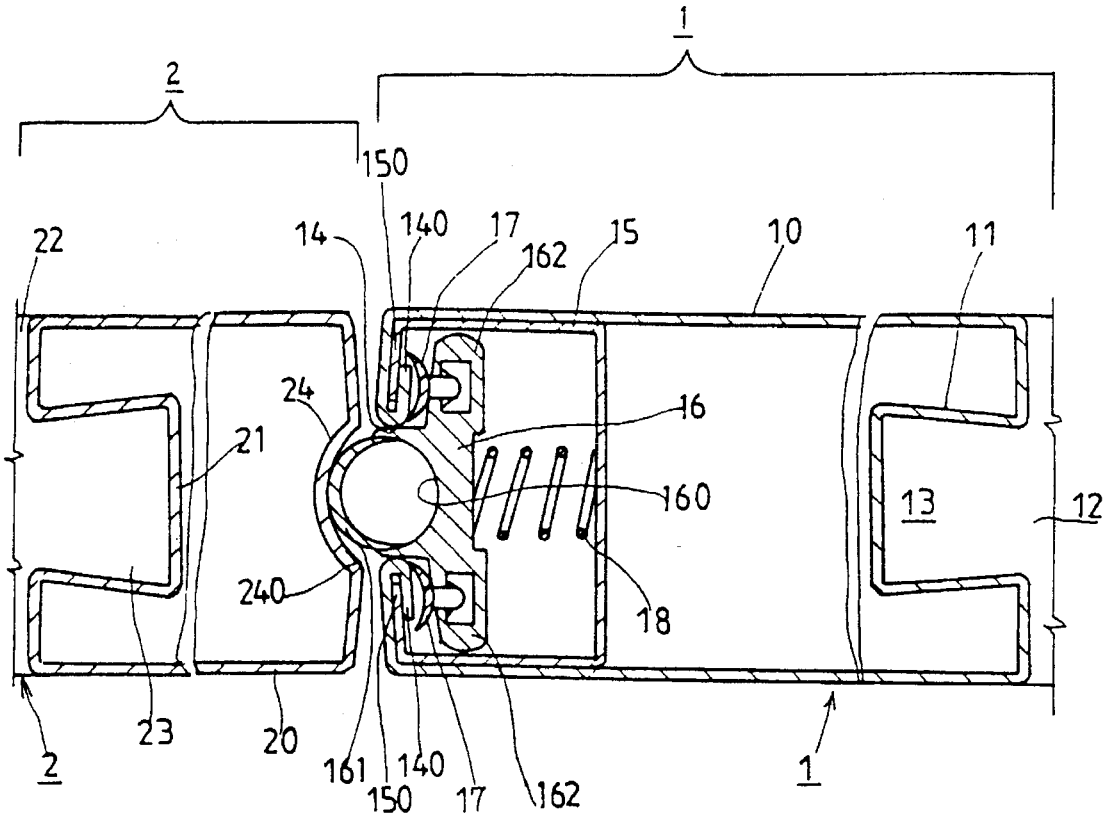
Figure 3B:
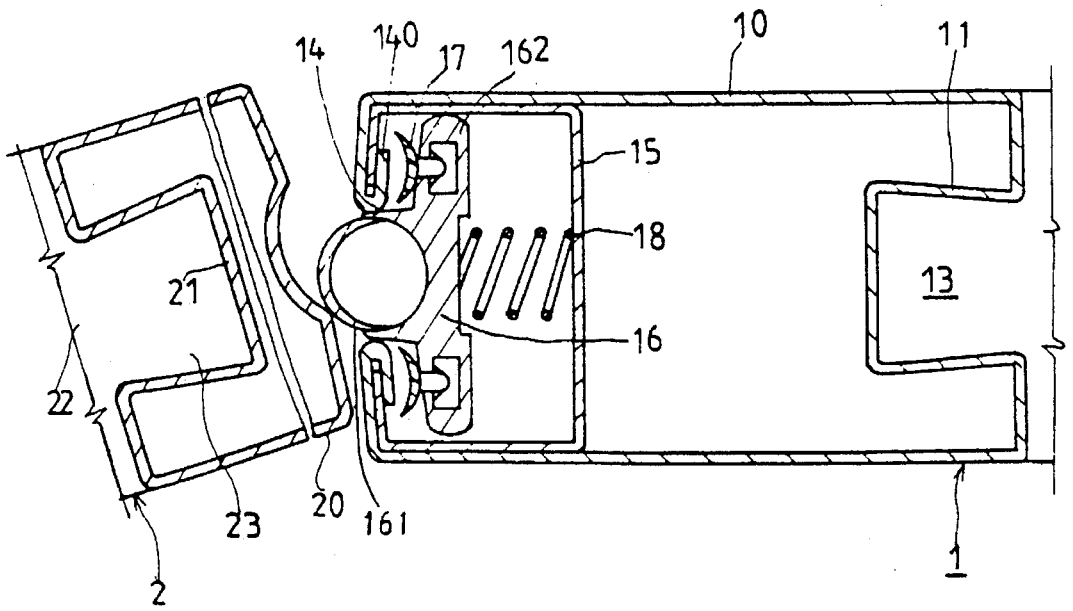

FIGS. 3A–3B each shows a cross-sectional view of a two-door unit provided with a sealing mechanism according to the first preferred embodiment of the present invention, wherein FIG. 3A shows when the two-door unit is closed, and FIG. 3B shows when the two-door unit is about to be opened. The two-door unit include two doors, a first door 1 and a second door 2. The first door 1 includes a door body 12 and a sidepiece 10 on the side opposite the second door 22, and similarly the second door 2 includes a door body 22 and a sidepiece 20 on the side opposite the first door 12. On the first door 1, its sidepiece 10 is formed with a grooved portion 11 and its door body 12 is formed with a ridged portion 13 such that the sidepiece 10 can be securely attached to the door body 12 by means of elastically clasping the ridge 13 with the grooved portion 11; similarly, on the second door 2, its sidepiece 20 is formed with a grooved portion 21 and its door body 22 is formed with a ridged portion 23 such that the sidepiece 20 can be securely attached to the door body 22 by means of elastically clasping the ridge 23 with the grooved portion 21.

Inside the sidepiece 10 on the first door 12 is there provided with an enclosure frame 15 secured to the sidepiece 10 by means of bending the ends 140 to tightly grasp the ends 150 of the enclosure frame 15. The provision of the enclosure frame 15 in addition can enforce the sidepiece 10 so that the side piece is more sturdy structured. The enclosure frame 15 houses a movable member 16 and a spiral spring 18 having one end affixed to the rear of the movable member 16 and the other end affixed to the enclosure frame 15.

Figure 5A:
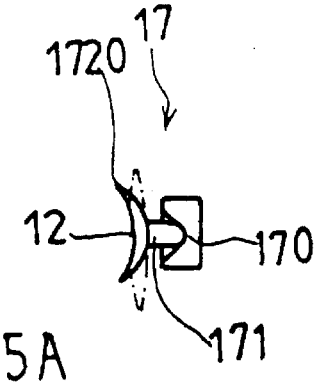
Figure 5B:
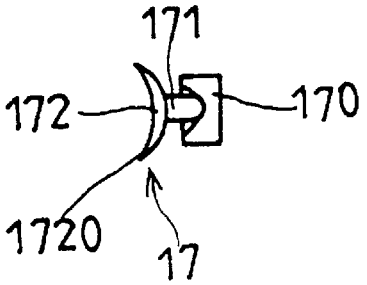
Figure 4:
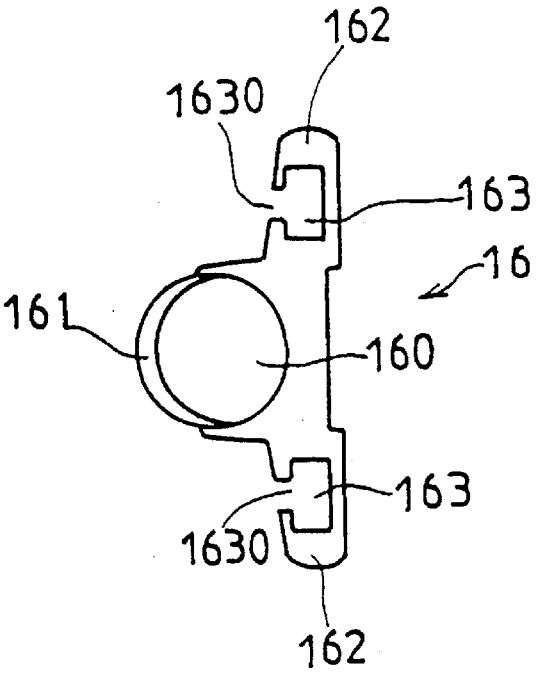
FIG. 4 shows a movable member used in the sealing mechanism shown in FIGS. 3A–3B.

Referring also to FIG. 4, the movable member 16 has a grooved portion 160 semi-circularly shaped in its cross section. A blocking member 161 crescent-shaped in its cross section is affixed to the edges of the grooved portion 160. The blocking member 161 has its two lateral ends 162 each provided with a slot 163 having an opening 1630. Through the opening 1630, the slot 163 can be mounted with a buffering member 17. Referring to FIGS. 5A–5B, each buffering member 17 is composed of three parts, an engaging part 170, a post 171, and a cushion 172. The engaging part 170 is used to mount the buffering member 17 on the movable member 16 by inserting it into the slot 163 in the movable member 16. The cushion 172 is made of a flexible material such as rubber and crescent-shaped in its cross section. When the cushion 172 is pressed against, its curved ends 1720 can be flatted as shown in FIG. 5A, and when the external force is removed, restore to the original shape as shown in FIG. 5B.

Referring now solely to FIG. 3A, when the two-door unit is closed, the movable member 16 is pushed by the spiral spring 18 such that the blocking member 161 is pressed against the curved recess 24 on the sidepiece 20 on the second door 2. As a result, the gap between the two sidepieces 10, 20 on the respective doors 1, 2 is such tightly sealed that air is prevented from flowing therethrough.

Referring next to FIG. 3B, when a person pushes the two-door unit open, the blocking member 161, due to its circular surface, can slide smoothly along the curvature of the curved recess 240. When the blocking member 161 reaches the edge 140 of the curved recess 24, the blocking member 161 will be pushed against by the slightly protruded edge 140. Due to the provision of the spiral spring 18, the blocking member 161 under this condition can be pushed into the room in the enclosure frame 15, thus allowing it to pass over the slightly protruded edge 240. Onwards, after the blocking member 161 has passed over the edge 240, the elasticity of the spiral spring 18 causes the blocking member 161 again to stick out of the room in the enclosure frame 15.

When closing the door unit, the blocking member 161 comes to meet the edge 240 first, which pushes the blocking member 161 into the room in the enclosure frame 15, thus allowing the blocking member to pass over the edge 240 and enter into the curved recess 24. Onwards, the blocking member 161 slides smoothly along the curvature of the curved recess 24 to the center position and at the same time the elasticity of the spiral spring 18 gradually pushes the blocking member 161 outwards. The door unit is completely closed when the blocking member 161 reaches at the center position of the curved recess 24.

In the process of the elastic restoration, however, a drawback would exist if the buffering member 17 were not provided. The door sidepiece 10 and the movable member 16 are all made of metal, the bumping of which against each other could produce noises. With the provision of the buffering member 17, such noise could be substantially eliminated.

Second Preferred Embodiment

Figure 6A:
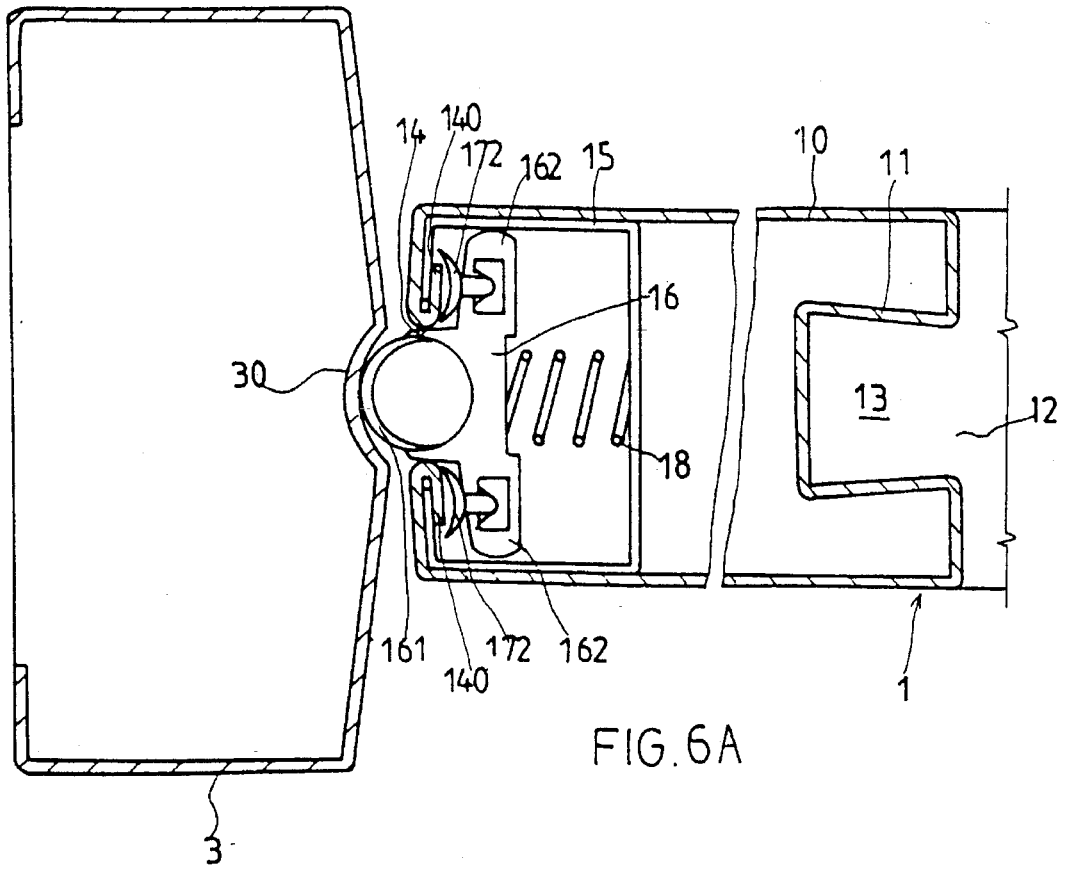
FIG. 6A shows the door unit in closed condition.
Figure 6B:
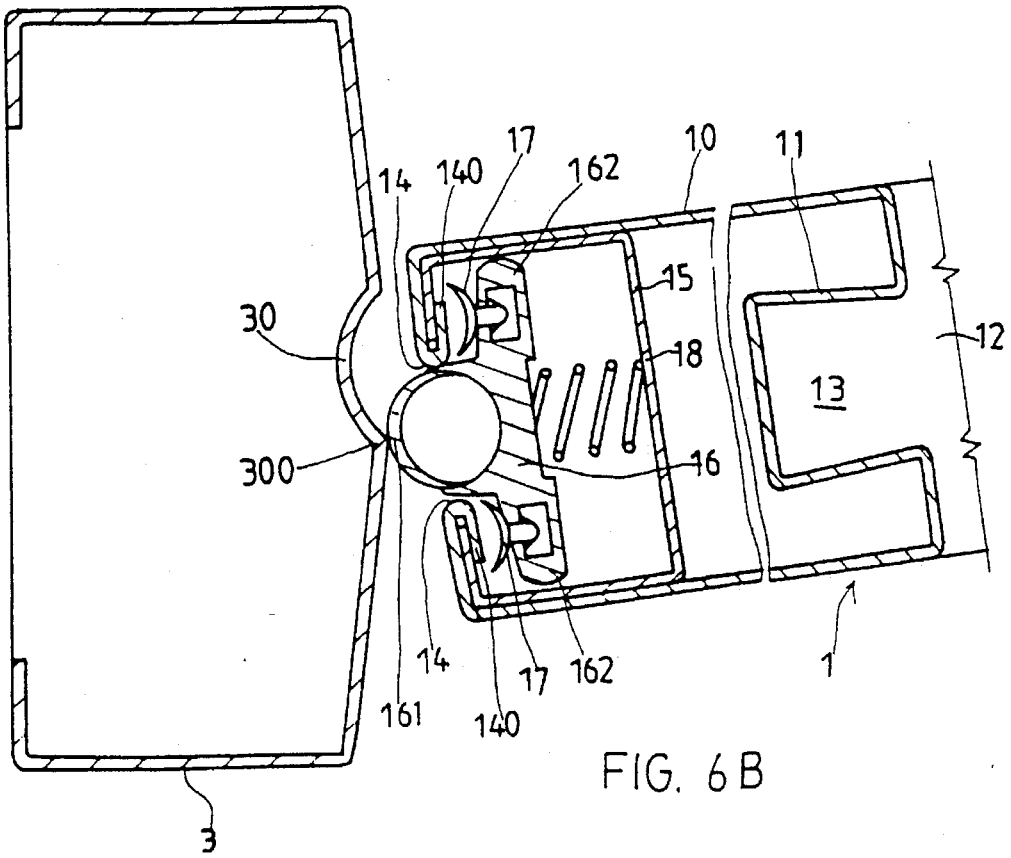
FIG. 6B shows the door unit half opened.

Referring to FIGS. 6A–6B, there are shown another preferred embodiment of the present invention wherein the gap between the hinged side of a door 1 and the doorjamb is sealed. In these drawings, the elements that are same in structure and function as those shown in FIG. 3A–3B are designated by the same numerals. Beside these identical elements, a sidepiece 3 is attached to the doorjamb of the door 1, which is, similarly, formed with a curved recess 30 having a protruded edge 300.

FIG. 6A shows the door unit in closed condition and FIG. 6B shows the door unit half opened. The mechanical actions involved here in the opening and closing of the door unit is completely similar to the previous embodiment shown in FIG. 3A–3B. Detailed description thereof thus will not be repeated.

Third Preferred Embodiment

Figure 7A:
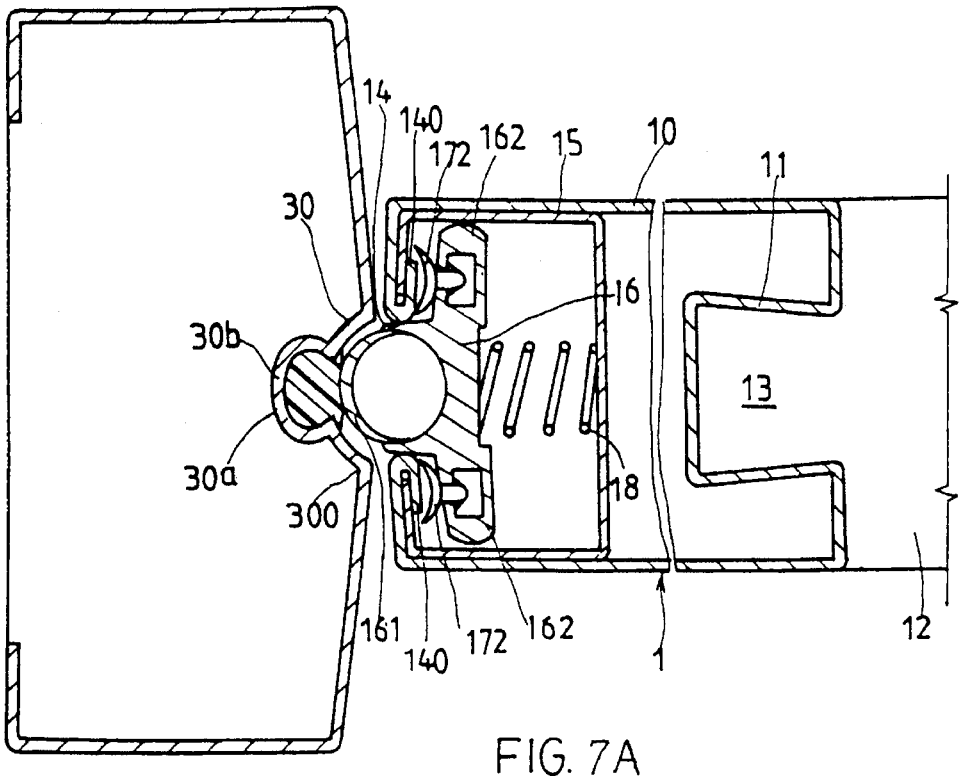
Figure 7B:
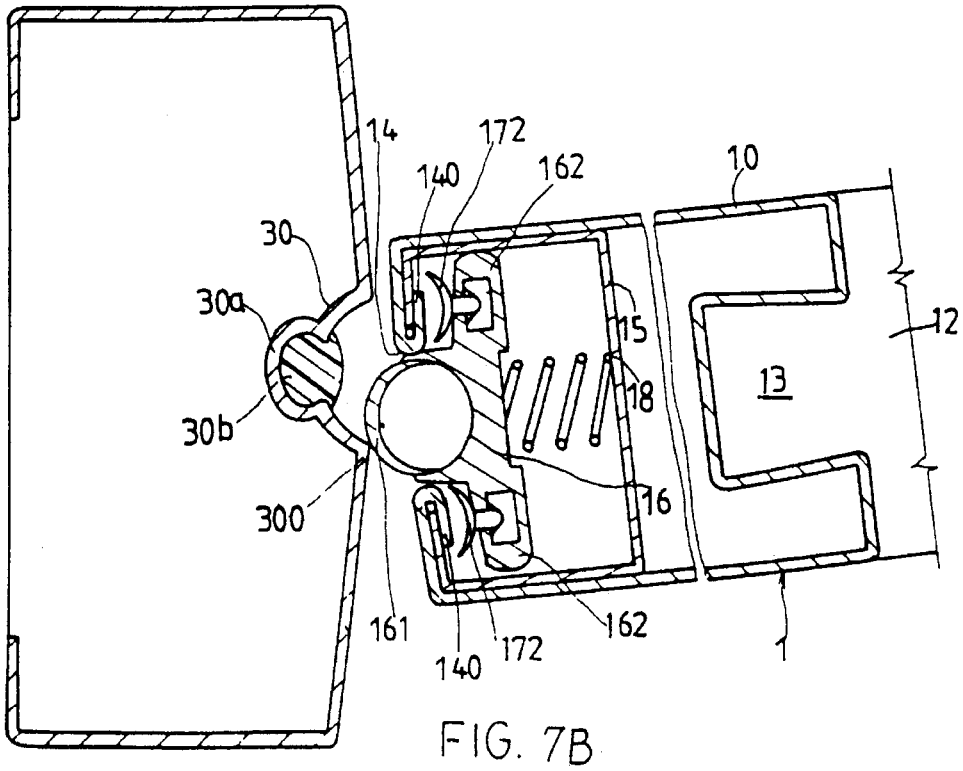

Referring to FIGS. 7A–7B, there are shown still another preferred embodiment of the present invention used to seal the gap between the hinged side of a door 1 and the doorjamb. In these drawings, the elements that are same in structure and function as those shown in FIG. 6A–6B are designated by the same numerals.

The only difference between this embodiment and that shown in FIGS. 6A–6B is that the curved recess 30 in FIGS. 7A–7B is here further excavated down to form a niche **30*a*. In the niche 30*a* is there stuffed with a bar-shaped buffering member 30*b*** (shown in cross section in the drawings) made of elastic and flexible material such as rubber.

In previous embodiments shown in FIGS. 3A–3B and FIGS. 6A–6B, although the bumping noise caused in the elastic restoration of the movable member 16 back to the original position can be substantially eliminated by the provision of the cushions 172, that caused in the collision of the blocking member 161 with the curved recesses 24 (in FIGS. 3A–3B) and 30 (in FIGS. 6A–6B) still exist. With the provision of the rubber-made bumping member **30*b***, the bumping noise there can thus be substantially eliminated.

Furthermore, it is another drawback of the previous embodiments that since both the blocking member 161 and the surface of the curved recesses 24 (in FIGS. 3A–3B) and 30 (in FIGS. 6A–6B) are rigid, air tightness provided thereby is just to a satisfactory level. With the provision of the rubber-made bumping member **30*b*, the blocking member 161' here can slightly deform the bumping member 30*b* by pressing against it when the door unit is in closed condition. Due to the restoration force from the deformed portion against the blocking member 161'**, a virtually absolute air-tightness sealing effect is provided.

Fourth Preferred Embodiment

Figure 8:
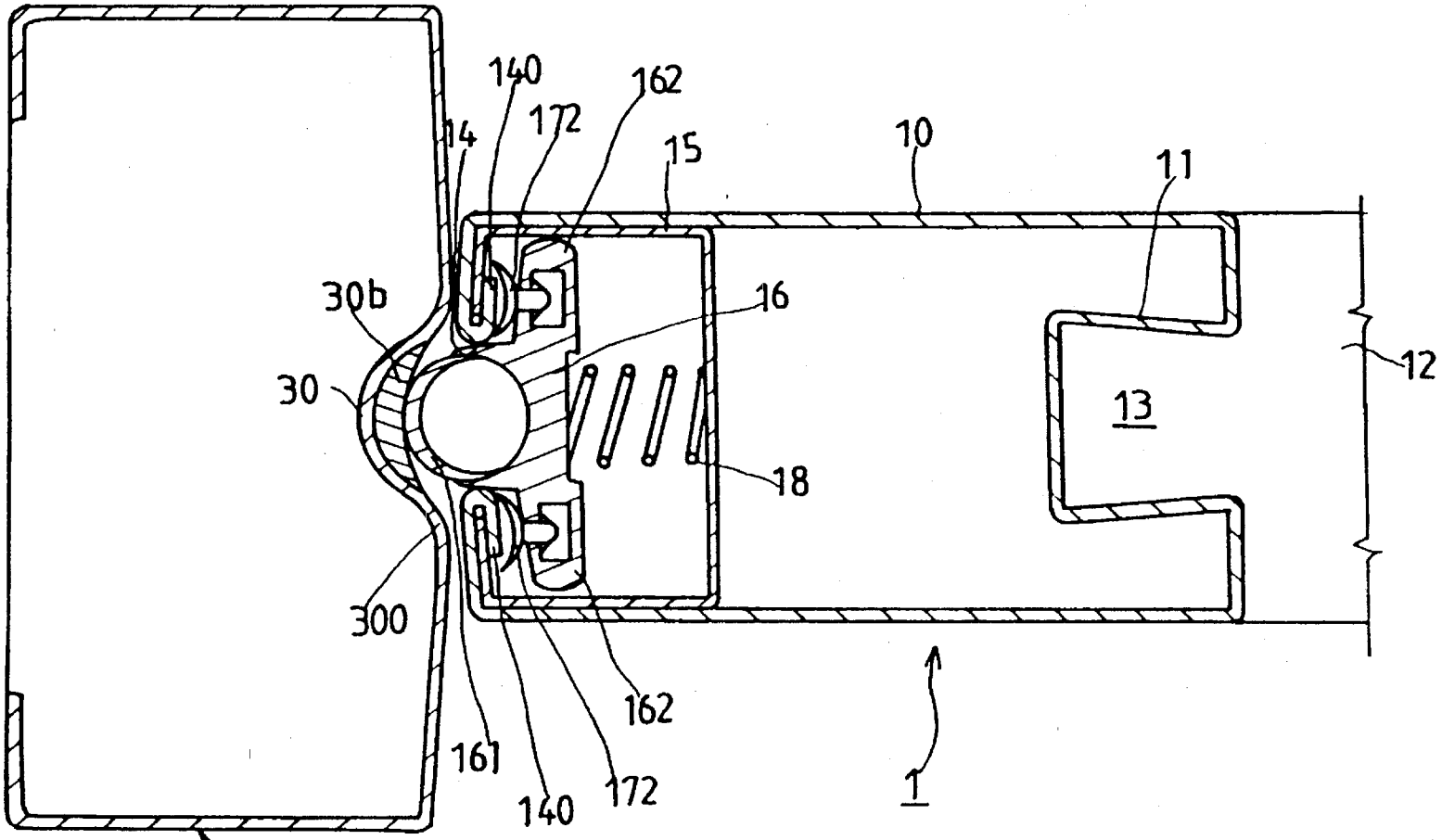
FIG. 8 shows a cross-sectional views of a sealing mechanism according to the fourth preferred embodiment of the present invention.

FIG. 8 shows another preferred embodiment of the present invention, which is a variation to that shown in FIGS. 7A–7B. The only difference between the embodiment shown here and that shown in FIGS. 7A–7B is that here the forming of the niche **30*a* in the curved recess 30 (FIGS. 7A–7B) is eliminated, and instead a buffering member 30*b*' (FIG. 8) crescent-shaped in its cross section and molded with a surface that matches the curvature of the curved recess 30'** is used.

The variation shown here eliminated the requirement of forming a niche in the curved recess. Therefore, manufacture is made easier. Also, the attaching of the bumping member **30*b*' to the curved recess 30'** is made easier.

Fifth Preferred Embodiment

Figure 9:
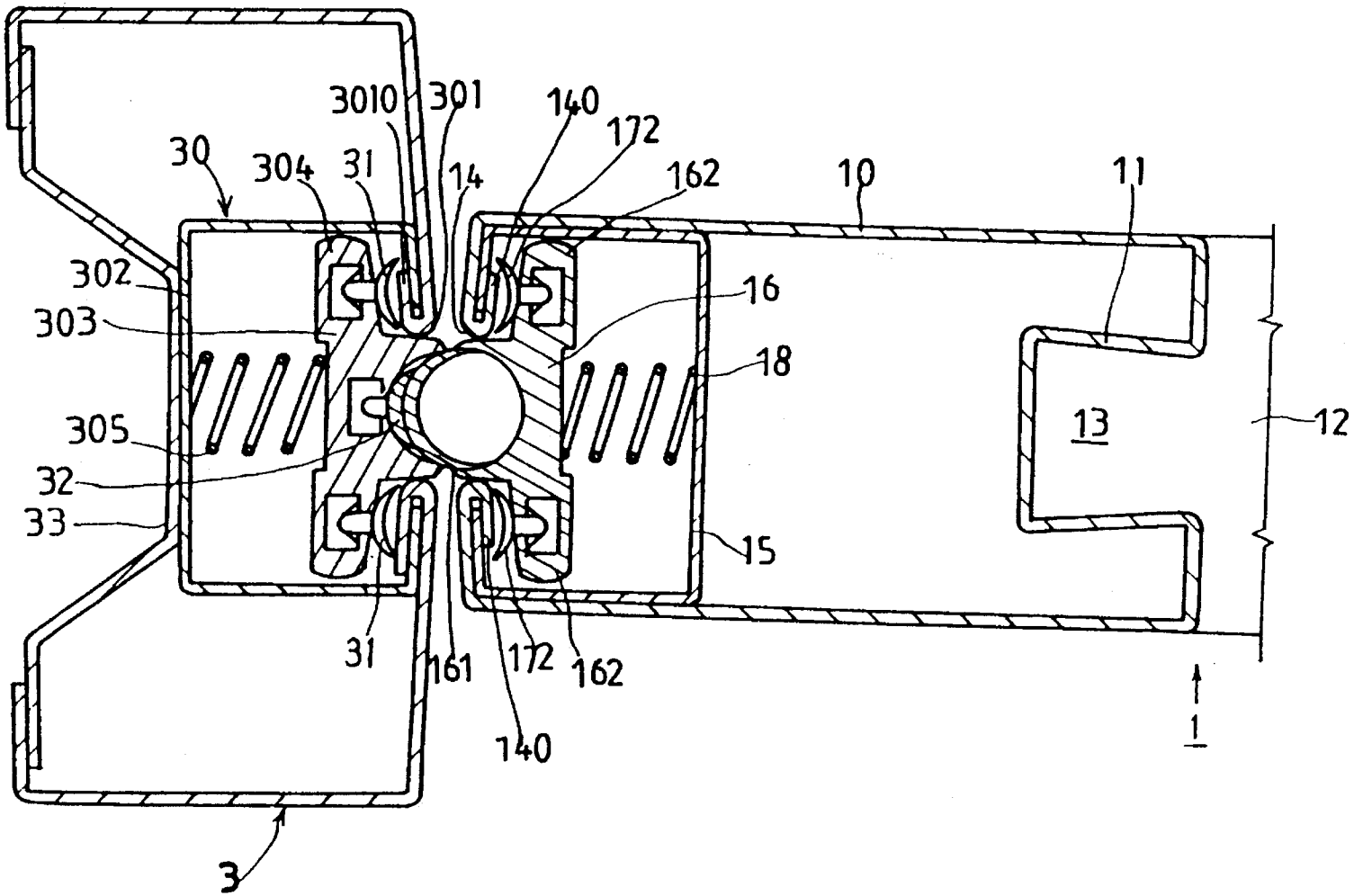
FIG. 9 shows a cross-sectional views of a sealing mechanism according to the fifth preferred embodiment of the present invention.

FIG. 9 shows still another preferred embodiment of the sealing mechanism according to the present invention in which a cushioning mechanism is provided on the doorjamb opposing the door 1 where the blocking member 161' is provided. On the side of the door 1, the sidepiece 10 and those elements housed therein including movable member 16, buffering member 17', and spiral springs are all identical in structure and function as those disclosed in the previous embodiments. Detailed description thereof thus will not be repeated.

In this embodiment, a sidepiece 3 is affixed to the doorjamb that hinges the door 1. Similarly, in the opposing part, the cushioning mechanism also includes an enclosure frame 30' which houses a movable member 303 and a spiral spring 305 having one end affixed to the enclosure frame 30' and the other affixed to the rear of the movable member 303. A bent piece 33 is used to support the enclosure frame 30'.

Figure 10:
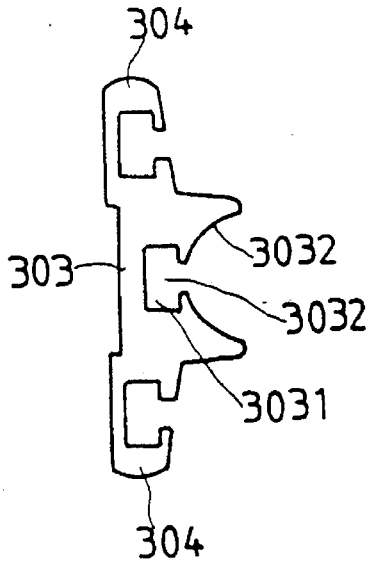
FIG. 10 shows a movable member employed in the sealing mechanism shown in FIG. 9.
Figure 11:
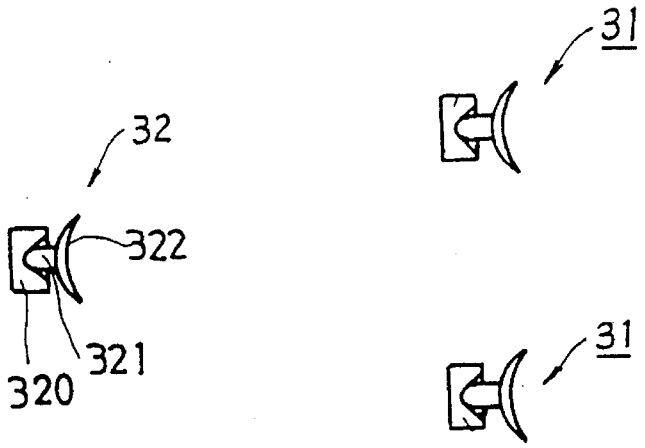
FIG. 11 shows the three buffering members employed in the sealing mechanism shown in FIG. 9.

The detailed structure of the movable member 303 is shown in FIG. 10, which includes a curved portion 3030 for receiving the blocking member 161' on the opposite side, two slots 304 for engaging with a pair of buffering members 31 and another slot 3031 having an opening 3032 for mounting an additional buffering member 32. The three buffering members 31, 32, as shown in FIG. 11, are all identical in structure as those shown in FIGS. 5A–5B, all including an engaging part 320, a post 321, and a cushion 322 (using the buffering member 32 as representative), but the buffering members 31 are used to prevent bumping noise from colliding with the bent ends 3010 that secure the enclosure frame 30' and the buffering member 32 is used, similar in function to the bumping members **30*b* (in FIGS. 7A–7B) and 30*b*' (in FIG. 8), to prevent bumping noise from colliding with the blocking member 161'**.

Furthermore, when opening the door unit, the two movable members 303, 16' on either sides can move backwards due to the provision of the spiral springs 305, 18' on either sides such that the blocking member 161' can easily and smoothly slide away from the cushion 322 on the opposing bumping member 32. When closing the door, the process is not only easy and smooth but also quiet due to the provision of the bumping members 31, 32 to prevent bumping noise from being generated by metal collisions.

Sixth Preferred Embodiment

Figure 12:
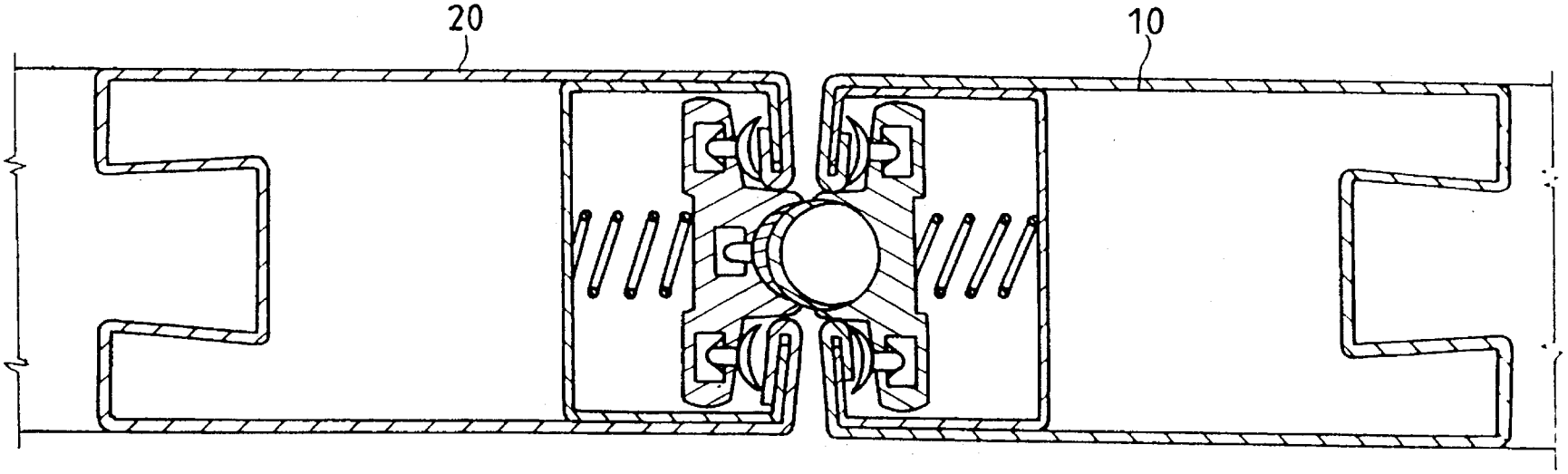
FIG. 12 shows a cross-sectional views of a sealing mechanism according to the sixth preferred embodiment of the present invention.
Figure 13A:
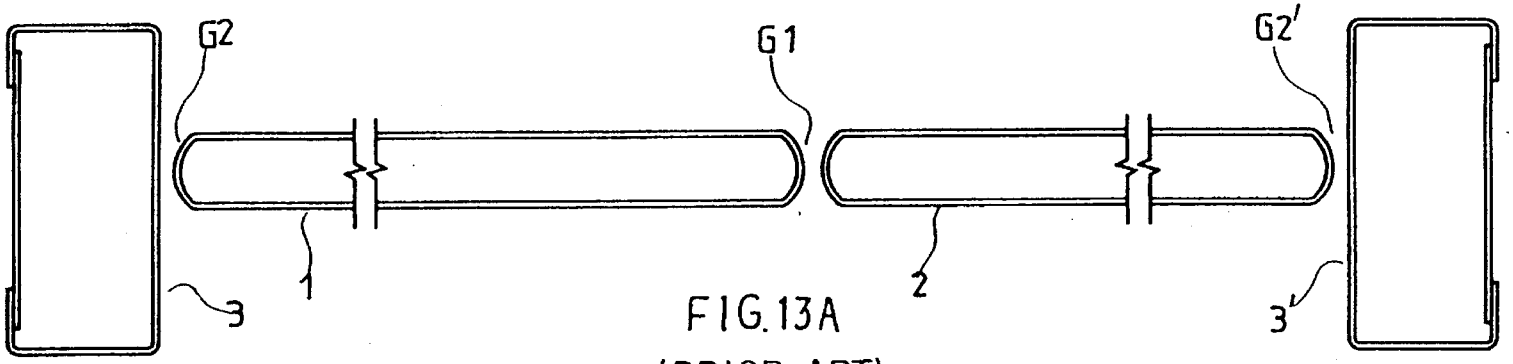
FIG.13A (PRIOR ART)
FIGS. 13A–13B are cross-sectional views of a two-door unit used to depict the problem of air gap left through the doors when the door unit is closed.
Figure 13B:
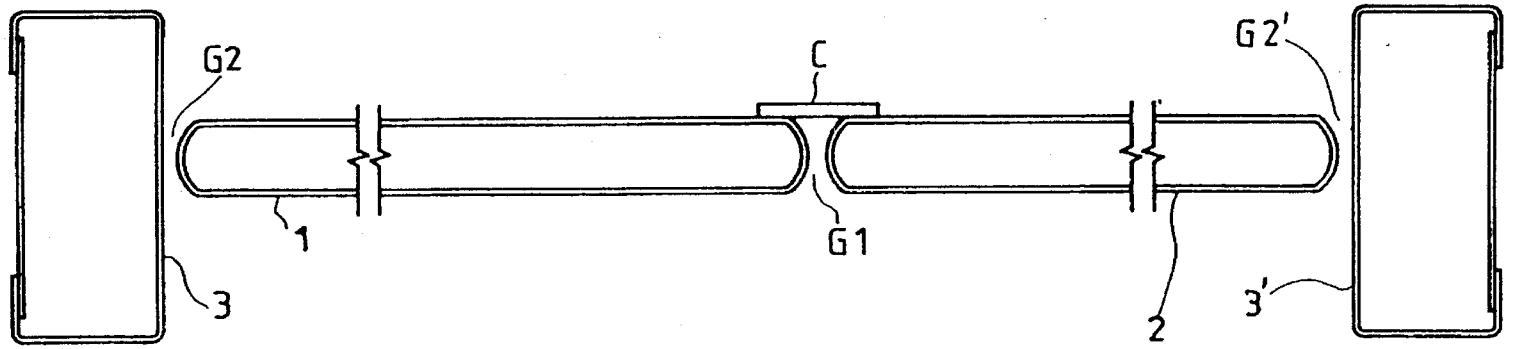
FIG.13B (PRIOR ART)

FIG. 12 shows another embodiment of the sealing mechanism according to the present invention. In this embodiment, the same cushioning mechanism shown in FIG. 9 is provided here to seal the gap between two doors in a two-door unit. The structure and function are all identical to those disclosed in FIG. 9 so that detailed description thereof will not be repeated.

The present invention has been described hitherto with several exemplary preferred embodiments. However, it is to be understood that the scope of the present invention need not be limited to the disclosed preferred embodiments. On the contrary, it is intended to cover various modifications and similar arrangements within the scope defined in the following appended claims. The scope of the claims should be accorded the broadest interpretation so as to encompass all such modifications and similar arrangements.

What is claimed is:

1. A sealing mechanism sealing a gap between a first door part and a second door part, comprising:

(a) a blocking mechanism enclosed in a sidepiece provided on the first door part, said blocking mechanism including:

(i) a blocking member shaped with a curved surface;

(ii) a movable member supporting said blocking member, said movable member being retractable when said blocking member is subjected to an exerting force;

(iii) resilient means, coupled to said movable member, for restoring said movable member to an original position when the exerting force on said blocking member is removed; and (iv) a pair of first buffering members provided on said movable member so as to prevent bumping noise between said movable member and the first door part; and (b) a curved recess provided on the second door part; wherein when the first door part and the second door part are closed, said blocking member comes into tight contact with said curved recess due to said resilient means; and when the first door part and the second door part are opened, said blocking member slides along said curved recess to thereby leave contact with said curved recess.

2. A sealing mechanism according to claim 1, in which said blocking member is substantially crescent-shaped in its cross-section.

3. A sealing mechanism according to claim 1, in which said resilient means is a helical spring.

4. A sealing mechanism according to claim 1, in which said curved recess is formed with a niche for stuffing a buffering member opposing said blocking member.

5. A sealing mechanism according to claim 1, in which said curved recess is attached with a second buffering member thereon opposing said blocking member, said buffering member being substantially crescent-shaped in its cross-section and having a curved surface that fits said buffering member into said curved recess.

6. A sealing mechanism according to claim 1, in which said curved recess is replaced by a cushioning mechanism provided on the second door part, including:

(a) a buffering member opposing said blocking member in said blocking mechanism;

(b) a second movable member supporting said buffering member, said second movable member being retractable when its said buffering member is subjected to an exerting force;

(c) second resilient means, coupled to said second movable member, for restoring said second movable member to an original position when the exerting force on its said buffering member is removed; and (d) an additional pair of buffering members provided on said second movable member so as to prevent bumping noise.

7. A sealing mechanism according to claim 6, in which said second resilient means is a helical spring.

8. A sealing mechanism according to claim 6, in which said cushioning mechanism itself presents a curved recess.

9. A sealing mechanism according to claim 1, in which said first door part is a hinged side of a door and said second door part is a doorjamb.

10. A sealing mechanism according to claim 1, in which said first door part is a free side of a door and said second door part is a doorjamb.

11. A sealing mechanism according to claim 1, in which said first door part is a free side of a door and said second door part is a free side of another door.

* * * * *